US005901408A

United States Patent [19]

Miller et al.

[11] Patent Number: 5,901,408

[45] Date of Patent: May 11, 1999

[54] TANK CARRY HANDLE AND SECUREMENT LATCH

[75] Inventors: Daniel R. Miller, Massillon; David M. J. Allgeier, North Canton, both of Ohio; David M. Anderson, North Hindsdale, Ill.; Carl Behrend, North Chicago, Ill.; James C. Hand, Glen Ellyn, Ill.; Gregg A. McAllise, North Canton, Ohio

[73] Assignee: The Hoover Company, North Canton, Ohio

[21] Appl. No.: 08/862,757

[22] Filed: May 23, 1997

[51] Int. Cl.[6] ..... A47L 9/32

[52] U.S. Cl. ..... 15/339; 15/320; 15/353; 15/410; 220/756

[58] Field of Search ..... 15/320, 321, 353, 15/410; 220/23.83, 23.86, 324, 756, 763, 764

[56] References Cited

U.S. PATENT DOCUMENTS

| | | | |
|---|---|---|---|
| 292,042 | 1/1884 | Palmer . | |
| D. 345,034 | 3/1994 | Fitzwater . | |
| 1,109,639 | 9/1914 | Sutton . | |
| 1,365,123 | 1/1921 | Owen et al. . | |
| 1,368,276 | 2/1921 | Mathews . | |
| 1,369,713 | 2/1921 | Smith . | |
| 1,384,998 | 7/1921 | Graham . | |
| 1,405,924 | 2/1922 | Lanning . | |
| 1,423,773 | 7/1922 | Mathews . | |
| 2,390,196 | 12/1945 | Taylor . | |
| 2,683,888 | 7/1954 | Ripple . | |
| 3,155,270 | 11/1964 | Taft . | |
| 3,316,579 | 5/1967 | Smith . | |
| 3,323,675 | 6/1967 | Van Der Ham et al. . | |
| 3,365,743 | 1/1968 | Haggstrom . | |
| 3,491,398 | 1/1970 | Segesman . | |
| 3,540,072 | 11/1970 | Wolter et al. | 15/320 |
| 3,653,190 | 4/1972 | Lee et al. | 15/352 X |
| 3,742,546 | 7/1973 | Crener et al. | 15/320 X |
| 4,068,340 | 1/1978 | Forward | 15/339 X |
| 4,193,161 | 3/1980 | Scott | 15/410 X |
| 4,287,562 | 5/1989 | Blase et al. | 220/763 X |
| 4,498,214 | 2/1985 | Oxel . | |
| 4,574,421 | 3/1986 | Froese | 15/339 |
| 4,592,482 | 6/1986 | Seager . | |
| 4,724,681 | 2/1988 | Bartholomew . | |
| 5,086,537 | 2/1992 | McDowell et al. . | |
| 5,169,018 | 12/1992 | Fiore | 220/756 X |
| 5,237,719 | 8/1993 | Dwyer, Jr. et al. . | |
| 5,237,720 | 8/1993 | Blase et al. | 15/321 |
| 5,301,386 | 4/1994 | Thomas et al. . | |
| 5,400,462 | 3/1995 | Amoretti | 15/321 |
| 5,406,673 | 4/1995 | Bradd et al. . | |
| 5,447,252 | 9/1995 | Ward | 220/756 |
| 5,513,415 | 5/1996 | Kent et al. . | |
| 5,640,738 | 6/1997 | Williams et al. . | |

FOREIGN PATENT DOCUMENTS

| | | |
|---|---|---|
| 71846 | 5/1916 | Austria . |
| 604713 | 9/1970 | Canada . |

*Primary Examiner*—Chris K. Moore

*Attorney, Agent, or Firm*—A. Burgess Lowe; Bruce P. Watson

[57] ABSTRACT

An open top solution supply or recovery tank that is removably mounted on a carpet extractor or wet pickup vacuum cleaner and has a lid that is removably mounted to and seals the top of the tank. A generally U-shaped carry handle is pivotally attached to opposite sides of the tank for carrying the tank. The ends of the carry handle have lid latching member extending therefrom that engage lid retaining members extending from opposite sides of the lid, to securely latch the lid on the tank at least when the carry handle is in a latched position. Tank latch arms are also provided that securely latch the tank to the cleaner when the carry handle is in the latched position. The tank latch arms are pivotally connected to the ends of the handle. Key pins extending from opposite sides of the tank are received in key ways in the latch arms. The key pins control the motion of the latch arms and ensure that the latch arms latch the tank to the cleaner when the handle is pivoted to the latched position.

49 Claims, 5 Drawing Sheets

TANK CARRY HANDLE AND SECUREMENT LATCH

FIELD OF THE INVENTION

This invention pertains to a carry handle for carrying a removable solution tank on a wet pickup vacuum cleaner or on a carpet extractor. More particularly, this invention pertains to such a carry handle that also serves as a latch for selectively latching a lid to the tank and for latching the tank to the cleaner.

BACKGROUND OF THE INVENTION

Canister type carpet extractors having a large recovery tank, a removable power head that encloses the top of the tank, and a carry handle that selectively latches the powerhead to the recovery tank are known. Such a carry handle may be used to carry the entire extractor when the powerhead is latched in place by the handle. This type of handle may also be unlatched, so that the powerhead may be removed. Once the powerhead is removed the tank may be carried by the handle to a sink and emptied. Since the electric motor and fan assembly are located in the power head, it is cumbersome to remove the relatively large and heavy powerhead from the recovery tank in this type of arrangement. Furthermore, when the powerhead is removed from the tank to empty the tank of recovered solution, dirty solution frequently drips from the powerhead onto the floor. As a result, removing the powerhead to empty this type of an extractor is typically a messy cumbersome process.

Carpet extractors are also known that have a base or caddy portion onto which the solution supply tank and solution recovery tank are removably mounted. The supply and recovery tanks on this type of extractor are typically held in place upon the caddy by the force of gravity or by latches located on the base portion. The tanks frequently have carry handles for ease of lifting and carrying the tanks. Some tanks contain a lid having a latch thereon for releasably latching the lid onto the tank to prevent the tank from spilling while being carried separate from the base portion. This type of tank typically requires the user to release the latch on the base to remove the tank from the base (often after removing a cover or housing that encloses the tank) and to release the latch on the lid to remove the lid from the tank in order to empty or clean the tank.

Carpet extractors are also known to include a removable cleaning solution supply tank having a carry handle that serves as a carry handle and as a latch for selectively latching the supply tank to the extractor. Such a handle provides for ease of mounting the supply tank to and ease of removing the supply tank from the extractor. An example of this type of handle is disclosed in commonly owned U.S. Pat. No. 5,406,673 issued on Apr. 18, 1997 entitled Tank Carry Handle and Securement Latch.

SUMMARY OF THE INVENTION

It is an object of the present invention to provide a recovery tank on either a floor scrubber, a wet/dry vacuum cleaner or a carpet extractor (collectively referred to hereinafter as floor care appliances) with a liquid storage tank having a carry handle that doubles as a securement latch for releasably latching the tank onto the appliance.

It is a further object of the present invention to provide such a liquid storage tank in which the handle also serves as a latch for releasably latching a lid onto the tank.

It is a further object of the invention to provide such a liquid storage tank in which the handle (i) latches both the lid onto the tank and the tank onto the floor care appliance when the handle is in a latched position, (ii) latches the lid to the tank and releases the tank from the cleaner for carrying the tank separate from the appliance when the handle is in a carry position, and (iii) releases the lid from the tank for removal of the lid and discharge of the contents of the tank when the handle is in a discharge position.

It is a further object of the present invention to provide one of a solution supply tank and a solution recovery tank on a carpet extractor having a handle that latches a cleaning liquid storage or recovery tank to the extractor in a latched position and that releases the tank from the extractor when the handle is simply grasped by a single hand and lifted to a carry position, such that the tank may be unlatched and lifted from the extractor with a single hand in a single lifting motion.

It is a further object of the present invention to provide such a tank in which a lid is latched onto the tank by the handle when the handle is in the latched position and when the handle is in the carry position.

The foregoing and other objects, that will be readily apparent from the following description of a preferred embodiment and the attached drawings, are achieved in one preferred embodiment of the present invention, by providing an open top solution supply or recovery tank that is removably mounted on a carpet extractor and a lid that is removably mounted to and seals the top of the tank. A generally U-shaped carry handle is pivotally attached to opposite sides of the tank for carrying the tank. The ends of the carry handle have lid latching members extending therefrom that engage lid retaining members extending from opposite sides of the lid, to securely latch the lid on the tank at least when the carry handle is in a latched position. Tank latch hooks are also provided that securely latch the tank to the carpet extractor when the carry handle is in the latched position.

In one form of the present invention, the lid retaining and latching members are preferably arcuate members extending from the lid and the ends of the carry handle, respectively, into engagement with each other to securely latch the lid onto the tank. The tank retaining and latching members are concentric to the pivot axis of the carry handle. Moreover, the tank latching members have an arcuate span of sufficient length that the tank latching members engage the tank retaining members when the carry handle is in a substantially horizontal latched position and when the carry handle is in a generally upright carry position, but not when the handle is in a discharge position on the opposite side of vertical relative to the latching position. With this construction, the lid is securely latched to the tank both when the tank is latched to the carpet extractor and when the tank is being carried by the carry handle and is removable when the handle is pivoted to the discharge position.

The tank latch hooks are preferably elongate tank latch arms that are pivotally connected to the ends of the carry handle at one end thereof and have hooks formed on the other ends thereof. The latch arms slidingly and pivotally engage key pins extending out from opposite sides of the recovery tank. When the carry handle is pivoted to the latched position, the latch arms are guided by the key pins such that the hooks hook onto tank retaining members on the carpet extractor and securely latch the tank on the extractor.

The tank latch arms preferably pull on the tank retaining members to securely seat the tank on the carpet extractor. A boss and recess detente arrangement is provided on the lid latching and retaining members to releasably retain the carry handle in the latched position in opposition to the pull on the latch arms. A resilient hook may be provided on the carry handle, in place of or in addition to the detente arrangement, that releasably hooks onto a peripheral edge of the recovery tank to releasably retain the carry handle in the latched position.

BRIEF DESCRIPTION OF THE DRAWINGS

The invention will now be described, by way of example, with reference to the accompanying drawings, of which.

DETAILED DESCRIPTION OF THE INVENTION

Figure 1:
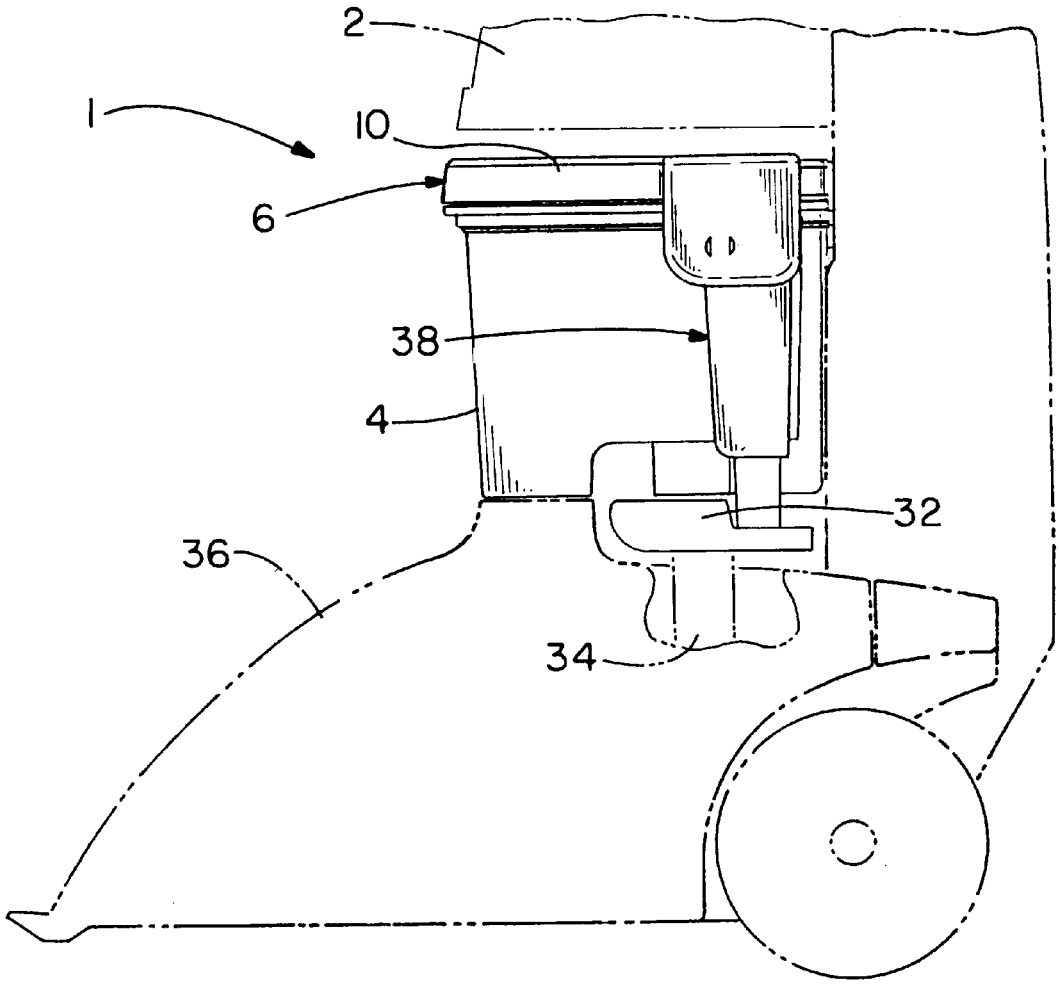
FIG. 1 is a left side elevational view of an upright carpet extractor having a recovery tank with a combined carry handle and securement latching according to the present invention.

FIG. 1 illustrates an upright carpet extractor 1 having a cleaning solution supply tank 2 and a cleaning solution recovery tank 4. The remaining portions and operation of such an upright carpet extractor do not form a part of the present invention and are therefore not described in detail herein. However, a detailed description of the operation and structure of such an upright carpet extractor can be found in co-owned U.S. Pat. No. 5,500,977 issued on Mar. 26, 1996 entitled Upright Carpet Extractor.

Figure 3:
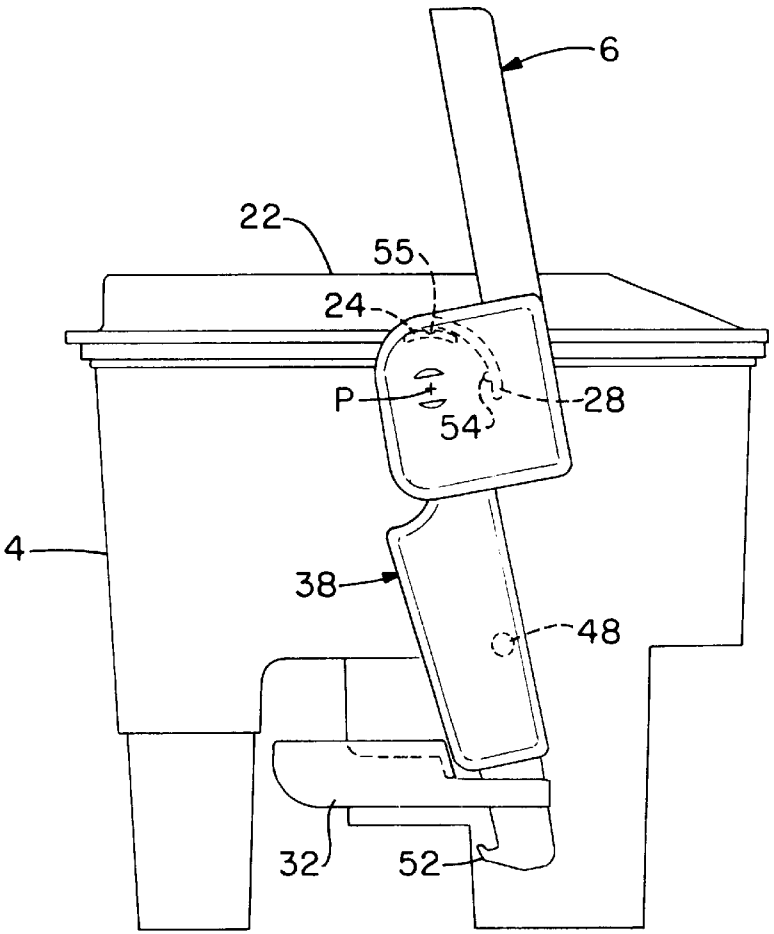
FIGS. 2, 3 and 4 are illustrative side views of the recovery tank of FIG. 1 with the handle in the latched position, carry position and discharge position, respectively.
Figure 2:
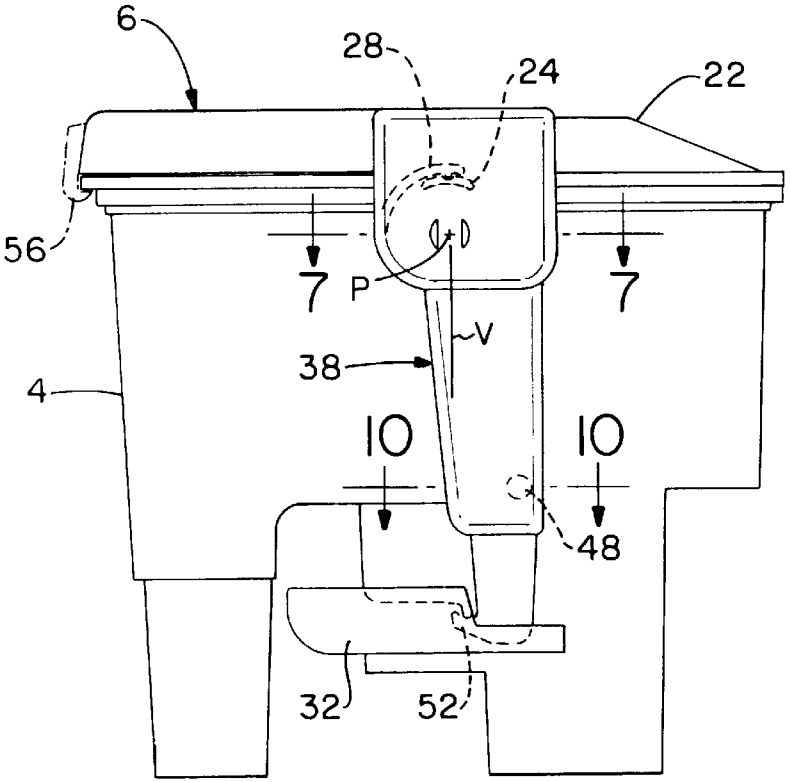
Figure 5:
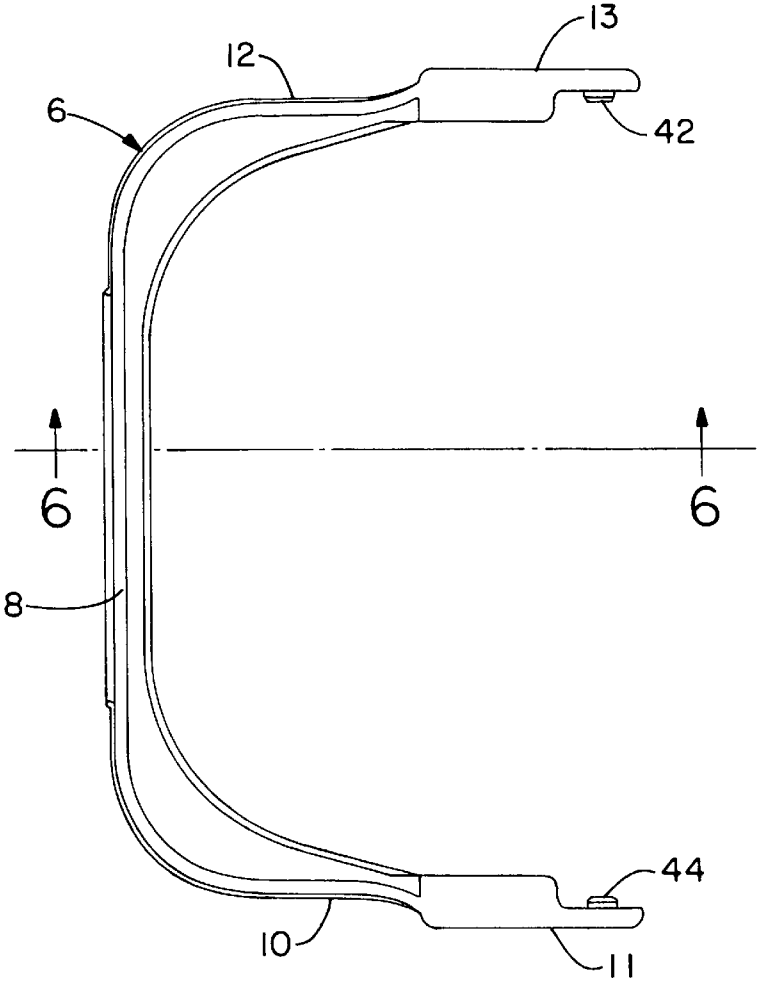
FIG. 5 is a plan view of the carry handle removed from the tank.
Figure 4:
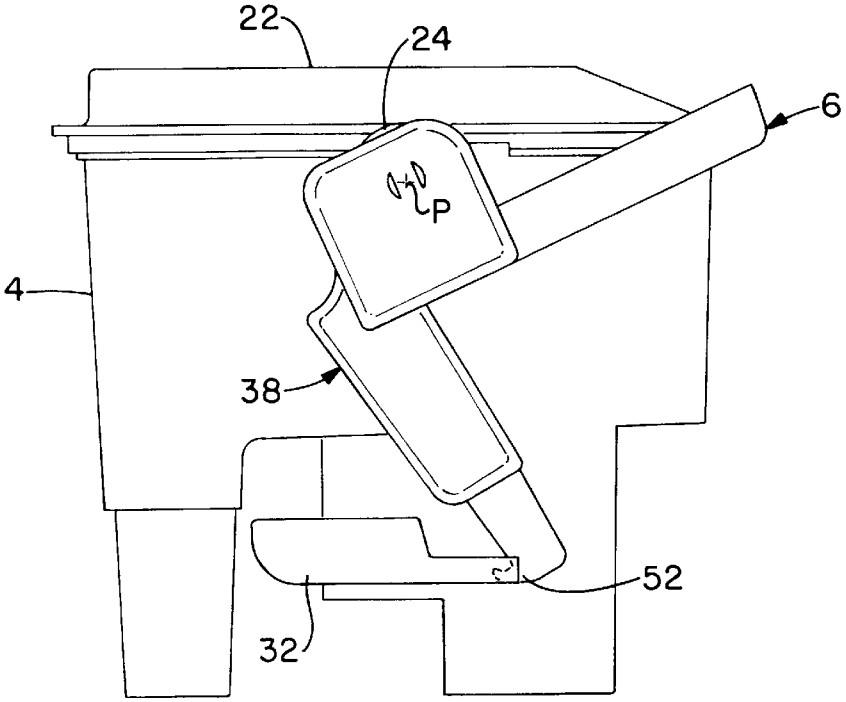

As best seen in FIGS. 2 through 4, the recovery tank 4 according to one form or embodiment of the present invention is an open topped tank provided with a generally U-shaped carry handle 6. The carry handle 6 has a transverse handgrip portion 8 and a pair of spaced leg portions 10 and 12 (see FIGS. 5 and 6). The carry handle 6 is pivotally attached to the tank by mounting cylindrical sleeves 14 and 16, that extend inward from inner surfaces of the ends 11 and 13 of the leg portions of the handle, over respective pivot posts 18 (only one of which is illustrated in FIG. 7) that extend out from opposing sides of the recovery tank.

The pivot posts 18 are preferably located on the recovery tank 4 such that pivot axis P of the handle 6 generally intersects the center of gravity of the recovery tank 4 when the recovery tank is filled to capacity with recovered liquid. The carry handle 6 is pivotable into a forward, generally horizontal latched position (FIGS. 1 and 2), a generally upright carry position (FIG. 3) and a rearward tank discharge position (FIG. 4).

A recovery tank cover or lid 22 sealingly closes the top of the recovery tank 4. Lid retaining members 24 (only one of which is illustrated) are preferably located on opposing outer edges of the lid 22 to engage respective lid latching members 28 and 30 on inner surfaces of the ends 11 and 13 of the carry handle 6 to securely latch the lid onto recovery tank. The lid latching members 28 and 30 are preferably sized and arranged on the carry handle such that the lid latching members engage the lid retaining members 24 and latch the lid on the tank when the handle is in the latched position (FIG. 2) and when the handle is in the carry position (FIG. 3), but not when the handle is in the discharge position (FIG. 4).

In order to achieve the desired latching function of the lid latching members, the lid latching members 28 and 30 are preferably arcuate members that are located concentric to the pivot axis P. When the carry handle 6 is in the latched position (FIG. 2), the lid latching members cross a vertical plane V that intersects the pivot axis P of the legs 10 and 12 of the handle (see FIG. 6). Thus, the lid latching members 28 and 30 engage the respective lid retaining members 24 and securely latch the lid 22 to the tank when the handle is in the latched position (see FIG. 2). The lid latching members 28 and 30 also preferably extend at least about 90 degrees about the pivot axis P from vertical plane V (see angle A in FIG. 6), such that they engage the respective lid retaining members 24 and latch the lid to the tank when the handle is in the carry position (see FIG. 3).

Figure 8:
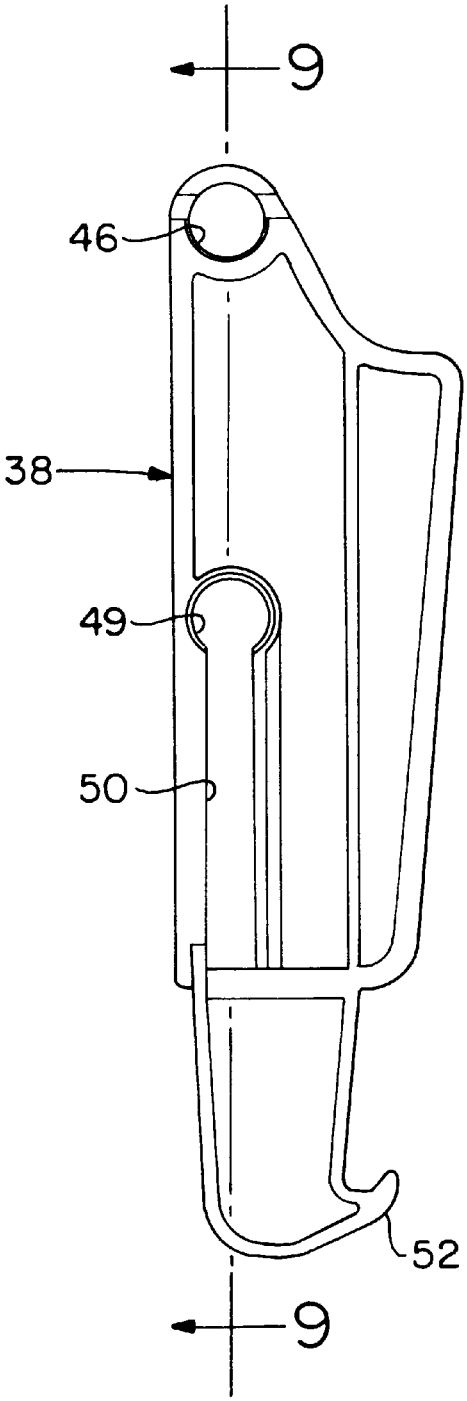
FIG. 8 is an elevational view of the inside face of the left side tank latch arm, the right side tank latch being a mirror image thereof.
Figure 9:
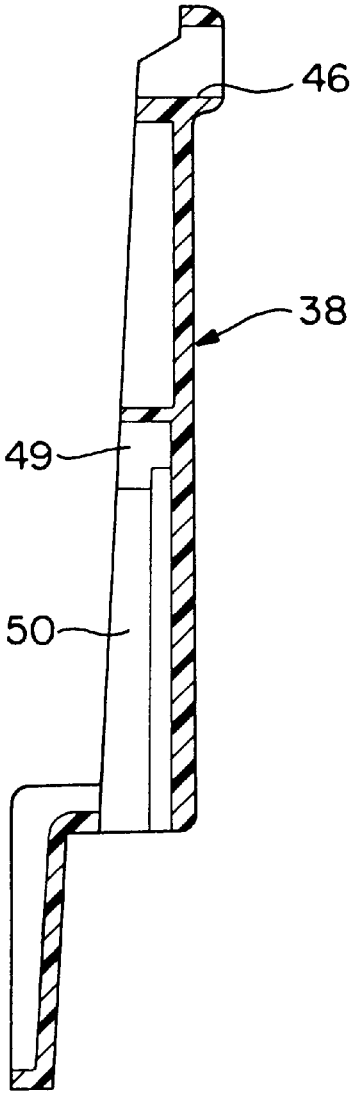
FIG. 9 is a longitudinal cross-section of the left side tank latch arm taken along line 9—9 in FIG. 8.

The recovery tank 4 is removably mounted on a base module 36 of the carpet extractor 1 between a pair of spaced tank retaining members 32 (only one of which is illustrated) that are fixed to the top of respective columns 34 that extend up from the base module 36 (see FIG. 1). The columns 36 and the tank retaining members 32 may be mounted to or integrally formed with the base module of the carpet extractor. In order to securely latch the recovery tank 4 in place upon the base module 36, a pair of tank latch arms 38 (only one of which is illustrated) are preferably pivotally mounted to the respective ends 11 and 13 of the handle. The latch arms 38 are pivotably mounted to the handle 6 by passing openings 46 in the latch arms (see FIGS. 8 and 9) over respective pivot pins 42 and 44 extending in from the respective ends and of the handle (see FIG. 5) defining latch pivot or connection points. Only the left side latch arm 38 is illustrated. The right side larch arm is a mirror image of the left side latch arm.

Figure 10:
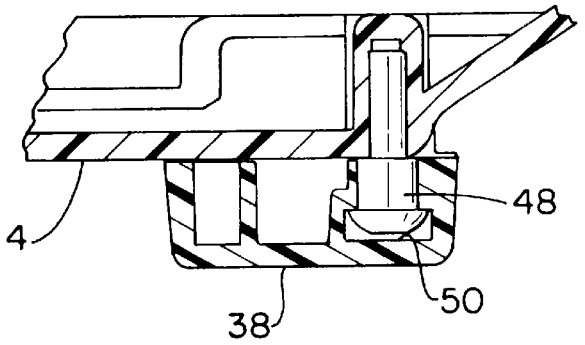
FIG. 10 is a partial cross-section taken along line 10—10 in FIG. 2 illustrating the sliding keyed connection between the tank latch arms and the recovery tank.

The tank latch arms 38 are preferably guided by respective key pins 48 (only one of which is illustrated in FIG. 10) extending out from opposite sides of the tank 4. The key pins 48 are passed through openings 49 in the respective latch arms 38 during assembly and are slidably received in key ways 50 in the latch arms 38. Furthermore, the key pins are located on the tank such that latch hooks 52 on ends of the tank latch arms 38 engage the respective tank retaining members 32 when the recovery tank is mounted on base module and the carry handle is in the latched position only.

Figure 6:
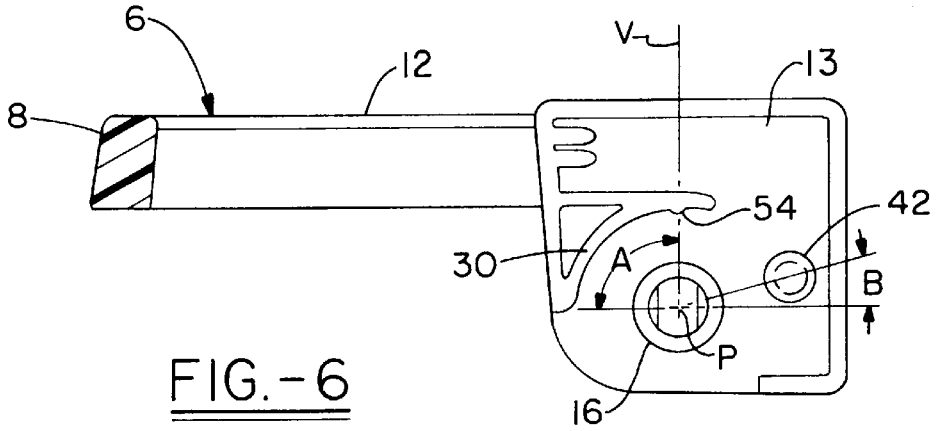
FIG. 6 is a cross-section of the handle taken along line 6—6 in FIG. 5.
Figure 7:
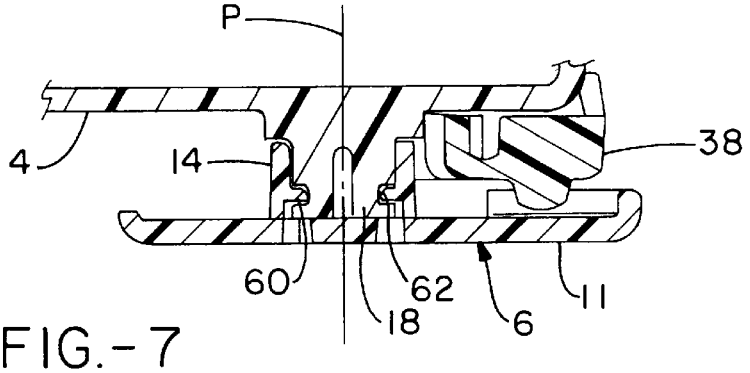
FIG. 7 is a partial cross-section taken along line 7—7 in FIG. 2 illustrating the pivot connection between the carry handle and the recovery tank.

More particularly, the pivot pins 42 and 44 are preferably located on a line extending radially from the pivot axis P at an acute angle, preferably about 15 degrees, above horizontal when the carry handle is in the latched position, as illustrated by angle B in FIG. 6. The key pins 48 are preferably located substantially vertically beneath the respective pivot pins 42 and 44. With this construction, the latch hooks 52 on the ends of the latch arms 38 move substantially vertically upward into engagement with the respective tank retaining members 32 at the end their movement when the carry handle is pivoted into the latched position.

The tank latch arms 38 preferably apply at least about a 5 lb. pull on the tank retaining members 32 to ensure that the recovery tank 4 is properly seated on the base module 36 and to ensure that a proper seal is formed between any air ducts that are contained in the tank 4 and any air ducts that are contained in the base module 36. A typical boss 54 and recess 55 detent arrangement is provided on the lid retaining member 24 and the lid latching members 28 and 30 to releasably retain the handle in the latched position in opposition to the 5 lb. pull on the latch arms. If desired, a resilient latch hook 56 (illustrated in ghost in FIG. 2 only) may be provided on the handgrip portion 8 in addition to or in place of the detent arrangement to releasably retain the carry handle 6 in the latched position and to ensure that an approximately 5 lb. pull is maintained by the tank latch arms 38.

Referring again to FIG. 7, it is desirable that the handle 6 snap onto the respective pivot posts 18 for ease of assembly. To this end, ribs 60 extend inward from opposing sides of the cylindrical sleeves 14 and 16 on the ends of the handle and corresponding recesses 62 are formed in opposite sides of the respective pivot posts 18. The ribs 60 are chamfered, such that when the sleeves 14 and 16 are pressed over the posts, the ribs snap over the ends of the posts 18 and are received in the recesses.

In operation, when it is desired to remove the tank from the extractor for emptying the contents of the tank, the carry handle 6 is grasped and pulled upward from the latched position. When the handle 6 is pulled upward, the handle pivots from the latched position shown in FIG. 2 to the carry position shown in FIG. 3. Pivotal motion of the handle to the carry position unhooks the latch arms from the tank retaining members (see FIG. 3), thereby unlatching the tank from the base module 36. Continued lifting motion will then lift the tank 4 from the base module 36. Thus, the tank is unlatched and lifted from the base module simply by grasping the carry handle and lifting up on the handle in a single continuous motion. The tank is then carried to a sink or other suitable location to empty the tank with the handle in the carry position. The lid 22 remains securely locked on the tank to prevent accidental spillage of the contents of the tank when the tank is carried by the carry handle. Once at the sink, the carry handle is further pivoted to the discharge position shown in FIG. 4, the lid is removed and the contents of the tank are discharged into the sink.

When it is desired to replace the lid 22 onto the tank 4, the handle 6 is first pivoted to the discharge position of FIG. 4 and then the lid is placed on the recovery tank 4. The handle 6 is then pivoted to the carry position of FIG. 3, latching the lid 22 on the tank 4, and the tank is lifted by the carry handle and placed on the base module 36 between the tank retaining members 32 and 34. Once the tank is in place on the base module, the handle is further pivoted to the latched position of FIG. 2. Pivotal motion of the handle to the latched position causes the latch arms to hook onto and pull on the tank retaining members, such that the tank is securely latched to the carpet extractor 1. The lid is now securely latched to the tank and the tank is securely latched to the extractor in proper position for operation of the extractor.

It will be appreciated that the extractor may be provided with a well or recess into which the recovery tank is received. In which case, the tank latch arms may be replaced with arcuate tank latching members, grooves or slots on the ends 11 and 13 of the carry handle that engage corresponding arcuate tank retaining members on opposite sides of the well when the carry handle is in the latched position, in order to latch the tank in place on the extractor in the same manner as the lid is latched onto the tank.

The combined carry handle and securement latch according to the present invention is described for use on a recovery tank on an upright extractor. However, it will be appreciated that the combined carry handle and securement latch according to the present invention may also be used on a canister type carpet extractor in which the recovery tank and the supply tank are both mounted to a base module. A handle according to the present invention may also be used to attach a cleaning solution supply tank on any type of carpet extractor, or to mount a removable recovery tank on the base of a wet/dry vacuum cleaner, or other floor care appliance.

Upon reading the above description it will become apparent to one of skill in the art that various modifications may be made to the disclosed preferred embodiment of the invention without departing from the scope of the present invention as described by way of example above and as set forth in the appended claims.

We claim:

1. A combined carry handle and securement latch for securing a lid onto a storage tank and for securing the tank in place on a floor care appliance, the combined handle and securement latch comprising:

a storage tank having opposing sides;

a tank lid having opposing sides and a pair of lid retaining members, one of the lid retaining members extending out from each of the opposing sides of the lid;

a tank carry handle having opposing ends, the ends of the carry handle being pivotally attached to the opposing sides of the tank for carrying the tank, lid latching members extending inward from the opposing ends of the handle for engaging corresponding said lid retaining members at least when the handle is pivoted to a latched position, for securely latching the lid upon the tank when the handle is in the latched position, and wherein the floor care appliance has a pair of spaced tank retaining members thereon, and the ends of the handle each have a tank latching member extending therefrom for engagement with corresponding said tank retaining members when the tank is located on the floor care appliance between the tank securing members and the handle is in the latched position, whereby the tank is securely latched in place upon the appliance when the handle is in the latched position.

2. A combined carry handle and securement latch according to claim 1, wherein the lid latching members comprise arcuate members that are substantially concentric to a pivot axis of the handle and that have an arcuate span sufficient to engage the tank retaining members when the handle is pivoted to the latched position and when the handle is pivoted to a generally upright carry position, whereby the lid is securely latched on the tank when the handle is in the latched position and when the handle is in the carry position.

3. A combined carry handle and securement latch according to claim 2, wherein the arcuate span of the lid latching members is such that the lid latching members are disengaged from the lid retaining members when the handle is pivoted to a discharge position, whereby the lid may be removed from the tank for discharging the contents of the tank when the handle is in the discharge position.

4. A combined carry handle and securement latch according to claim 3, wherein the tank latching members are adapted to disengage from the tank retaining members when the handle is pivoted to the carry position, whereby the recovery tank may be lifted from and placed on the floor care appliance when the handle is in the carry position.

5. A combined carry handle and securement latch according to claim 3, wherein the tank latching members comprise arcuate members and the tank retaining members comprise corresponding arcuate members.

6. A combined carry handle and securement latch according to claim 2, wherein the arcuate span of the lid latching members is at least about 90 degrees and the lid latching members are located on the handle such that the lid latching members engage the lid retaining members when the handle is in the carry position and when the handle is pivoted about 90 degrees in a first direction from the carry position to a generally horizontal said latched position.

7. A combined carry handle and securement latch according to claim 6, wherein the lid latching members are located on the handle such that the lid latching members are disengaged from the lid retaining members when the carry handle is pivoted in a second direction from the carry position, opposite the first direction, to a discharge position, whereby the lid may be removed for discharging the contents of the recovery tank when the handle is in the discharge position.

8. A combined carry handle and securement latch according to claim 2, wherein at least one of the lid latching members includes one of a boss and a recess that engages a corresponding other one of a boss and a recess on at least a corresponding one of the lid retaining members for releasably retaining the carry handle in the latched position.

9. A combined carry handle and securement latch according to claim 1, wherein the tank latching members each comprise an elongate latch arm, first ends of the latch arms are pivotally connected respective said ends of the handle at latch pivot points spaced from a pivot axis of the handle and second ends of the latch arms have hooks thereon for hooking onto respective said tank retaining members when the handle is in the latched position.

10. A combined carry handle and securement latch according to claim 9, further comprising a pair of key pins extending out from respective said opposing sides of the tank;

the latch arms each have key ways extending longitudinally therein for rotatably and slidably receiving a respective said key pin therein; and wherein the key pins are located such that the key pins guide the latch arms when the handle is pivoted into the latched position such that the hooks on the latch arms hook onto the tank retaining members and securely latch the tank on the floor care appliance.

11. A combined carry handle and securement latch according to claim 10, wherein the latch pivot points are located on a line extending radially from the handle pivot axis at an acute angle above horizontal when the handle is in the latched position, whereby the latch arms arch upward into engagement with the tank retaining members as the handle is pivoted to the latched position.

12. A combined carry handle and securement latch according to claim 11, wherein said angle is about 15° above horizontal.

13. A combined carry handle and securement latch according to claim 12, wherein the key pins are located substantially vertically below the latch pivot points when the handle is in the latched position, whereby the hooks on the latch arms move substantially vertically at the end of their motion into engagement with the tank retaining members as the handle is pivoted into the latched position.

14. A combined carry handle and securement latch according to claim 9, wherein the location of the latch pivot points and a length of the latch arms are such that the latch arms pull on the tank retaining members when the handle is in the latched position.

15. A combined carry handle and securement latch according to claim 14, wherein the latch pivot points and a length of the latch arms are such that the latch arms apply a pull of approximately five pounds upon the tank retaining members.

16. A combined carry handle and securement latch according to claim 14, further comprising a protruding lip on the tank and a resilient hook on a central grip portion of the handle that resiliently snaps over the protruding lip on the tank when the handle is pivoted to the latched position, for releasably retaining the handle in the latched position.

17. A combined carry handle and securement latch according to claim 9, wherein the lid latching members comprise arcuate members that are substantially concentric to a pivot axis of the handle and that have an arcuate span sufficient to engage the tank retaining members when the handle is pivoted to the latched position and when the handle is pivoted to a generally upright carry position, whereby the lid is securely latched on the tank when the handle is in the latched position and when the handle is in the carry position.

18. A combined carry handle and securement latch according to claim 9, wherein the arcuate span of the lid latching members is such that the lid latching members are disengaged from the lid retaining members when the handle is pivoted to a discharge position, whereby the lid may be removed from the tank for discharging the contents of the tank when the handle is in the discharge position.

19. A combined carry handle and securement latch according to claim 9, wherein the latch pivot points and a length of the latch arms are such that the latch arms pull on the tank retaining members when the handle is in the latched position.

20. A combined carry handle and securement latch according to claim 19, further comprising a protruding lip on the tank and a resilient hook on a central grip portion of the handle that resiliently snaps over a protruding lip when the handle is pivoted to the latched position, for releasably retaining the handle in the latched position.

21. A combined carry handle and securement latch according to claim 9, wherein at least one of the lid latching members include one of a boss and a recess that engages a corresponding other one of a boss and a recess on at least one of the lid retaining members to releasably retain the carry handle in the latched position.

22. A combined carry handle and securement latch according to claim 21, further comprising a protruding lip on the tank and a resilient hook on a central grip portion of the handle that resiliently snaps over the protruding lip when the handle is pivoted to the latched position, for releasably retaining the handle in the latched position.

23. A combined carry handle and securement latch according to claim 1, further comprising a hollow cylindrical handle mounting sleeve extending inward from each end of the carry handle and a generally cylindrical handle pivot post extending outward from each of the opposing sides of the tank, the handle pivot posts being sized, shaped and located to be rotatably received in the handle mounting sleeves for pivotally attaching the handle to the tank.

24. A combined carry handle and securement latch according to claim 23, further comprising at least one circumferentially extending recess in an outer peripheral surface of each of the handle pivot posts and at least one rib on an inner peripheral surface of each of the handle mounting sleeves, the recesses in the handle pivot posts and the ribs on the handle mounting sleeves being located such that the ribs are received in the recesses for retaining the ends of the carry handle on the handle pivot posts.

25. A liquid storage tank, comprising one of a cleaning liquid supply tank and a cleaning liquid recovery tank, for use with a floor care appliance, wherein said liquid storage tank comprises:

a) an open top tank having opposing sides;

b) a generally U-shaped carry handle having two spaced ends, the ends of the handle being pivotally mounted to the opposing sides of the tank thereby defining a handle pivot axis extending across the recovery tank;

c) the ends of the handle each having a lid latching member spaced from the pivot axis;

d) the lid having a pair of lid retaining members on opposing outer edges of the lid;

e) the lid latching members being located on the handle for engagement with the lid retaining members when the lid is on the recovery tank and the handle is pivoted to a latched position, whereby the lid is latched on the recovery tank when the handle is in the latched position;

f) a pair of tank retaining members on the floor care apparatus, the tank retaining members being spaced to receive the tank therebetween;

g) the ends of the handle each having a tank latching member thereon; and h) the tank latch members being arranged to (i) latch onto the tank retaining members when the tank is received on the floor care apparatus between the tank retaining members and the handle is pivoted to the latched position, whereby the tank is latched to the base module when the handle is in the latched position, and (ii) to be unlatched from the tank retaining members when the handle is pivoted to a generally upright carry position, whereby the tank may be lifted from the floor care apparatus and carried by the handle when the handle is in the carry position.

26. A storage tank according to claim 25, wherein the lid latching members comprise arcuate members that are substantially concentric to the pivot axis and that have an arcuate span sufficient to engage the lid retaining members when the handle is pivoted to the latched position and when the handle is pivoted to the carry position, whereby the lid is latched on the tank when the handle is in the latched position and when the handle is in the carry position.

27. A storage tank according to claim 26, wherein the lid latching members are sized and arranged to be disengaged from the lid retaining members when the handle is pivoted to a discharge position, whereby the lid may be removed from the tank for discharging the contents of the tank when the handle is in the discharge position.

28. A storage tank according to claim 27, wherein the lid latching members have an arcuate span of about 90 degrees and are located on the handle such that the lid latching members engage the lid locking members when the handle is in a generally vertical said carry position and when the handle is pivoted about 90 degrees in a first direction from the carry position to a generally horizontal said latched position.

29. A storage tank according to claim 27, wherein the tank latching members comprise elongate latch arms extending from each of the ends of the handle, with latch hooks being located on outer ends of each of the latch arms.

30. A storage tank according to claim 29, wherein inner ends of the latch arms are pivotally attached to the ends of the handle at latch arm connection points spaced from the handle pivot axis.

31. A storage tank according to claim 30, further comprising a key way formed in each of the latch arms and a pair of key pins extending from said opposing sides of the tank into respective said key ways for guiding the motion of the latch arms when the handle is pivoted into and out of the latched position.

32. A storage tank according to claim 31, wherein the latch arm connection points are located along a line extending radially from the tank pivot axis at an acute angle above horizontal when the handle is in the latched position, whereby the latch arms arch generally upward when the handle is pivoted to the latched position.

33. A storage tank according to claim 32, wherein the key pins are substantially vertically below the latch arm connection points when the handle is in the latched position, whereby the latch arms move substantially vertically at the end of their motion when the handle is pivoted to the latched position, such that the hooks move substantially vertically into engagement with the tank retaining members.

34. A storage tank according to claim 32, wherein a length of the latch arms and the latch arm connection points are selected such that the latch arms pull on the tank retaining members when the handle is in the latched position.

35. A storage tank according to claim 32, wherein at least one of the lid latching members include one of a boss and a recess that engages the other one of a boss and a recess on at least a corresponding one of the lid retaining members when the handle is in the latched position for releasably retaining the handle in the latched position in opposition to the pull on the latch arms.

36. A storage tank according to claim 25, wherein at least one of the lid latching members include one of a boss and a recess that engages the other one of a boss and a recess on at least one of the lid retaining members when the handle is in the latched position for releasably retaining the handle in the latched position.

37. An open top liquid storage tank having a removable lid for use with a floor care appliance, wherein the improvement comprises:

an open top liquid storage tank having opposite sides;

a generally U-shaped carry handle having a central grip portion and two leg portions extending generally perpendicularly from opposite ends of the grip portion, with ends of the leg portions being pivotally attached to respective said opposite sides of the tank defining a handle pivot axis;

a removable lid enclosing the top of the tank;

each leg portion having a lid latching member that engages the lid when the lid is on the tank and the handle is in a latched position, for securely latching the lid in place upon the tank; and each leg portion further having a tank latching member for engaging the floor care appliance when the tank is mounted thereon and the handle is in the latched position, for securely latching the tank in place upon the floor care appliance.

38. A storage tank according to claim 37, further comprising a pair of arcuate lid retaining members extending from opposite sides of the lid; and wherein the lid latching members are arcuate members sized and situated on the leg portions to matingly engage respective said lid retaining members when the handle is in the latched position.

39. A storage tank according to claim 38, wherein the lid latching members are concentric to the pivot axis of the handle and have an arcuate span sufficient to engage the lid retaining members when the handle is in a generally horizontal said latched position and when the handle is in a generally upright carry position.

40. A storage tank according to claim 39, further comprising a pair of tank retaining members on the floor care appliance, the tank retaining members being spaced to receive the tank therebetween; and wherein the tank latching members are sized and situated on the leg portions to i) engage the tank retaining members when the tank is located on the floor care appliance between the tank retaining members and the handle is in the latched position and ii) to disengage from the tank retaining members when the handle is pivoted to the carry position.

41. A storage tank according to claim 40, wherein the tank latching members comprise arcuate members and the tank retaining members comprise corresponding arcuate members.

42. A storage tank according to claim 39, further comprising a pair of tank retaining members on the floor care appliance that are spaced to receive the tank therebetween; and wherein the tank latching members comprises hooks that are sized and situated on respective said leg portions to i) engage the tank retaining members when the tank is located on the floor care appliance between the tank retaining members and the handle is in the latched position and ii) to disengage from the tank retaining members when the handle is pivoted to the carry position.

43. A storage tank according to claim 42, further comprising a key pin extending from each of said opposite sides of the tank, and a pair of elongate latch arms;

wherein the hooks are located on first ends of the elongate latch arms and second ends of the latch arms are pivotally connected to the leg portions at latch pivot points spaced from the handle pivot axis, the latch arms having generally longitudinally extending key ways, with the key pins being slidably and rotatably received in respective said key ways for guiding the motion of the latch arms when the handle is pivoted to the latched position to ensure that the hooks engage the tank retaining members.

44. A storage tank according to claim 43, wherein, when the handle is in the latched position, the latch pivot points are located on a line extending radially from the handle pivot axis at an acute angle above horizontal and the key pins are located substantially vertically below the latch pivot points, whereby at the end of the handles, pivotal motion into the latched position, the hooks travel substantially vertically into engagement with the tank retaining members.

45. A storage tank according to claim 42, wherein said acute angle is about 15° above horizontal.

46. A storage tank according to claim 37, further comprising a hollow cylindrical handle mounting sleeve extending inward from each end of the carry handle and a generally cylindrical handle pivot post extending outward from each of the opposing sides of the tank, the handle pivot posts being sized, shaped and located to be rotatably received in the handle mounting sleeves for pivotally attaching the handle to the tank.

47. A storage tank according to claim 46, further comprising at least one circumferentially extending recess in an outer peripheral surface of each of the handle pivot posts and at least one rib on an inner peripheral surface of each of the handle mounting sleeves, the recesses in the handle pivot posts and the ribs on the handle mounting sleeves being located such that the ribs are received in the recesses for retaining the ends of the carry handle on the handle pivot posts.

48. A storage tank according to claim 40, wherein the storage tank is a liquid recovery tank.

49. A storage tank according to claim 40, wherein the floor care appliance is an extractor and the storage tank is a cleaning liquid supply tank.

* * * * *